US006378784B1

(12) United States Patent
Allen et al.

(10) Patent No.: US 6,378,784 B1
(45) Date of Patent: Apr. 30, 2002

(54) DISPENSING SYSTEM USING A DIE TIP HAVING AN AIR FOIL

(75) Inventors: Martin A Allen, Dawsonville; Joel E. Saine, Dahlonega, both of GA (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 09/697,397

(22) Filed: Oct. 27, 2000

(51) Int. Cl.[7] ..... B05B 1/28

(52) U.S. Cl. ..... 239/296; 239/297; 239/298; 239/299; 239/300

(58) Field of Search ..... 239/296–300, 239/291, 294, 290; 425/7, 72.2, 192 S, 186, 188, 463, 464; 264/555, 103, 210.8, 211.14

(56) References Cited

U.S. PATENT DOCUMENTS

| | | | | |
|---|---|---|---|---|
| 3,773,263 A | * | 11/1973 | Binoche | 239/296 |
| 4,687,137 A | | 8/1987 | Boger et al. | |
| 4,891,249 A | | 1/1990 | McIntyre | |
| 4,949,668 A | | 8/1990 | Heindel et al. | |
| 4,957,783 A | * | 9/1990 | Gabryszewski | 427/424 |
| 4,983,109 A | | 1/1991 | Miller et al. | |
| 5,145,689 A | | 9/1992 | Allen et al. | |
| 5,196,207 A | * | 3/1993 | Koenig | 425/72.2 |
| 5,605,706 A | * | 2/1997 | Allen et al. | 425/72.2 |
| 5,618,566 A | | 4/1997 | Allen et al. | |
| 5,728,219 A | | 3/1998 | Allen et al. | |

* cited by examiner

*Primary Examiner*—James Hook
*Assistant Examiner*—Davis Hwn
(74) *Attorney, Agent, or Firm*—Wood, Herron & Evans, LLP

(57) ABSTRACT

A die tip for use in meltblowing liquid material onto a moving substrate having a layer of entrained air moving in a common direction therewith. The die tip includes a base member having a plurality of liquid dispensing outlets for dispensing liquid material toward the substrate and a plurality of air discharge outlets for discharging air toward the liquid material dispensed from the liquid dispensing outlets. The base member includes at least one air deflecting member extending outwardly from the base member and toward the substrate. The air deflecting member is operable to deflect the moving entrained air in a direction away from the air discharge outlets of the meltblowing die tip. The air deflecting member substantially reduces the build up of dust and other debris carried in the entrained air around the air discharge outlets to maintain consistent and reliable operation of the meltblowing die tip.

37 Claims, 4 Drawing Sheets

DISPENSING SYSTEM USING A DIE TIP HAVING AN AIR FOIL

FIELD OF THE INVENTION

The present invention relates generally to dispensing systems for applying a liquid material and, more particularly, to dispensing systems using air to fiberize a dispensed strand or filament of material before contacting a moving substrate. Any liquid dispensing system such as a meltblowing system comprises one or more modules, each having a die tip for applying the liquid material.

BACKGROUND OF THE INVENTION

Various systems for dispensing liquids are well known and can use the present invention. These include, but are not limited to airless spray systems which apply a liquid to a moving web or substrate, systems which use dispensed air to move or fiberize the dispensed liquid before contacting a non-moving substrate and systems which use dispensed air to move or fiberize the dispensed liquid before contacting a moving substrate. The present invention will be described in detail with respect to the latter type of system, and in particular a meltblowing dispensing system. Meltblowing dispensing systems have been developed for applying viscous material such as polymer material onto a moving substrate to form nonwoven fabric, and, more recently, for applying a pattern of hot melt adhesives onto a moving substrate during the manufacture of various products, such as diapers, feminine hygiene products, multiply tissues and the like. In general, meltblowing systems include a source of liquid material, a source of air, a manifold for distributing the liquid material and air, at least one and usually a plurality of modules mounted to the manifold for receiving the liquid material and air and dispensing an elongated filament of the liquid material which is attenuated and drawn down by the air before being randomly applied onto the substrate. Each module of the meltblowing system comprises a liquid material passage and an air passage and a die tip or nozzle. In general, a meltblowing die tip comprises a plurality of liquid material orifices or outlets arranged in a row and a slot on each side of the row of material orifices for dispensing the air. Instead of two slots, it is well known to use two rows of air orifices or outlets parallel to the row of material orifices.

One known type of meltblowing die tip used in applying hot melt adhesive material comprises a triangular nosepiece extending outwardly from the die tip and towards the substrate. The nosepiece is defined by a pair of converging walls which meet at an apex. A series of spaced adhesive orifices or outlets are aligned along the apex to dispense filaments of hot melt adhesive toward the substrate. Parallel rows of air discharge orifices or outlets are formed on opposite sides of the nosepiece to discharge jets of high velocity air. In each row there can be one or more than one air orifice associated with each adhesive orifice. The air orifices are typically elliptical in shape and formed adjacent the base of the triangular nosepiece with the air discharged generally parallel to the converging walls of the nosepiece. Of course, the air orifices can be other geometric shapes and the air can be channeled up the sides of the nosepiece through the use of an air plate to effectively place the air outlet adjacent to the adhesive orifice. The high velocity air jets on the opposite sides of the nosepiece are directed toward the dispensed filaments to draw down and attenuate the filaments to a reduced final diameter. The filaments of hot melt adhesive are deposited on the surface of a moving substrate to form an adhesive layer thereon onto which may be laminated another layer.

During the manufacture of multi-ply tissues, for example, a ply of tissue paper is conveyed past the meltblowing die which deposits a layer of fine adhesive fibers on the tissue paper before it is bonded to another ply. As the tissue paper moves toward the die tip, the air between the tissue and the die tip is agitated and moved in the same general direction as the tissue. In addition, due to the high velocity of the air being discharged from the air orifices, the air in the area adjacent the air orifices is aspirated toward the air orifice. This air between the tissue and die tip, referred to as entrained air, has particles of dust and other materials suspended in it. This is particularly prevalent in the environment where ply bonding is done, but is present to a lesser degree in any environment where material dispensing is done. This moving entrained air combines with the high velocity air to form process air which attenuates and draws down the filament of dispensed hot melt adhesive. However, the movement of the entrained air is not uniform in velocity or direction over the length of the die tip and this causes, to a lesser degree, the process air to also be non-uniform. The focus of the pattern of the filament applied to the moving substrate is negatively affected by the non-uniformity of the process air. In addition, the entrained air is drawn against the die tip which has been made tacky by the adhesive vapor or mist released during the normal melting of adhesives, and eventually, the dust particles build up against the face of the nosepiece and between the air discharge orifices until one or more of the high velocity air orifices are partially or completely blocked. As this build up of dust particles occurs, the balance of air pressure across the meltblowing die tip is disturbed and the nonuniformity of the process air increases, thus creating a less focused pattern of adhesive filaments on the tissue paper.

To combat the dust build up problem that occurs during the ply bonding process, manufacturers of paper products, for example multiply tissues, have invested in costly dust control systems to control the amount of dust in the vicinity of the adhesive dispensing system. While such control systems reduce the amount of dust in the air, the air orifices still become clogged or stopped and the adhesive dispensing system must still be taken off-line, so that the operator can take the appropriate maintenance actions. In addition, dust control systems are generally expensive and add to production costs. Thus, there is a need for an adhesive spraying die tip that increases the uniformity of the process air and is less susceptible to dust build up that may partially or completely block one or more of the high velocity air orifices.

SUMMARY OF THE INVENTION

The present invention is a die tip for use in a module or system for dispensing liquid material. The die tip of the present invention can be used in various liquid dispensing systems, but will be described herein as a die tip for use in a meltblowing system for applying a hot melt adhesive onto a moving substrate. The die tip improves the uniformity of the process air used to attenuate and draw down the dispensed filament of material and correspondingly, improves the consistency or focus of the pattern of the dispensed liquid. The die tip also minimizes the accumulation of dust and other particles around the melt and air discharge orifices caused by the motion of the entrained air between the die tip and the substrate. While the invention will be described in connection with certain embodiments, it will be understood that the invention is not limited to these embodiments. On the contrary, the invention includes all alternatives, modifications and equivalents as may be included within the spirit and scope of the present invention.

A meltblowing die tip in accordance with the preferred embodiment of the present invention includes a base member having a triangular nosepiece extending outwardly therefrom and toward the moving substrate. The nosepiece includes a pair of converging walls that terminate in an apex extending the full width of the base member. A series of liquid dispensing orifices or outlets are formed in spaced relationship along the apex for dispensing filaments of liquid material, such as hot melt adhesive, toward the substrate.

A pair of slots or a series of air discharge orifices or outlets are formed in spaced relationship in a pair of parallel rows disposed along opposite sides of the nosepiece. The air discharge outlets discharge high velocity air jets toward the filaments dispensed from the liquid dispensing outlets. The high velocity air jets draw down and attenuate the filaments to a reduced final diameter before they are deposited at random on the moving substrate.

In accordance with the present invention, an air foil extends outwardly from a lower surface of the base member and toward the moving substrate. The air foil preferably comprises a pair of air deflecting members extending the full width of the base member and positioned outboard of, and generally parallel with, the rows of air discharge outlets. The air deflecting member positioned upstream of the nosepiece has a radius or otherwise curved outer surface that deflects the entrained air moving toward the die tip, due to aspiration caused by the high velocity air and to air movement caused by the moving substrate, in a direction away from the air discharge outlets and at least partially toward the moving substrate, and creates a vortex that provides a positive air flow in a direction away from the air discharge outlets. The air deflecting member positioned downstream of the nosepiece has a radius or otherwise curved outer surface that deflects the entrained air moving toward the die tip, due to aspiration caused by the high velocity air, in a direction away from the air discharge outlets and at least partially toward the moving substrate and creates a vortex that provides a positive air flow in a direction away from the air discharge outlets. As a result of the entrained air being directed away from the air discharge outlets, the uniformity of the process air, high velocity air and entrained air combined, is increased, since the entrained air combines with the high velocity air at a point further away from the air discharge outlets than would otherwise occur which reduces the effect of the moving entrained air on the high velocity air, and the amount of dust or other particles built up at the die tip is reduced. Thus, the air deflecting members improve efficiency and focus of the pattern of the filaments applied to the moving substrate.

In the preferred embodiment, the air deflection members are symmetrical and are formed by making a pair of substantially identical parallel elongated slots on opposite sides of the nosepiece. Each slot intersects a row of air flow passages extending through the base member on opposite sides of the nosepiece to form the air discharge outlets at terminal ends of the air flow passages. The air discharge outlets on each side of the nosepiece lie in a common plane defined by a recessed wall of each slot. The plane defined by each recessed wall is substantially transverse to the axes of the air flow passages on each side of the nosepiece. In this way, the air discharge outlets are formed with a circular shape and are configured to discharge the high velocity air jets generally parallel to the converging walls of the nosepiece. The circular-shaped air discharge outlets improve the behavior of the high velocity air jets and also increase air efficiency over elliptical air discharge outlets of the past.

Further, the meltblowing die tip of the present invention reduces the need for expensive dust removal systems in the vicinity of the meltblowing dispensing system and reduces the amount of maintenance required to keep the meltblowing die tips clean and operational. The above and other objects and advantages of the present invention shall be made apparent from the accompanying drawings and the description thereof.

BRIEF DESCRIPTION OF THE DRAWINGS

The accompanying drawings illustrate embodiments of the invention, together with a general description of the invention given above, and the detailed description of the embodiments given below, serve to explain the principles of the invention.

DETAILED DESCRIPTION OF THE PREFERRED EMBODIMENT

Figure 1:
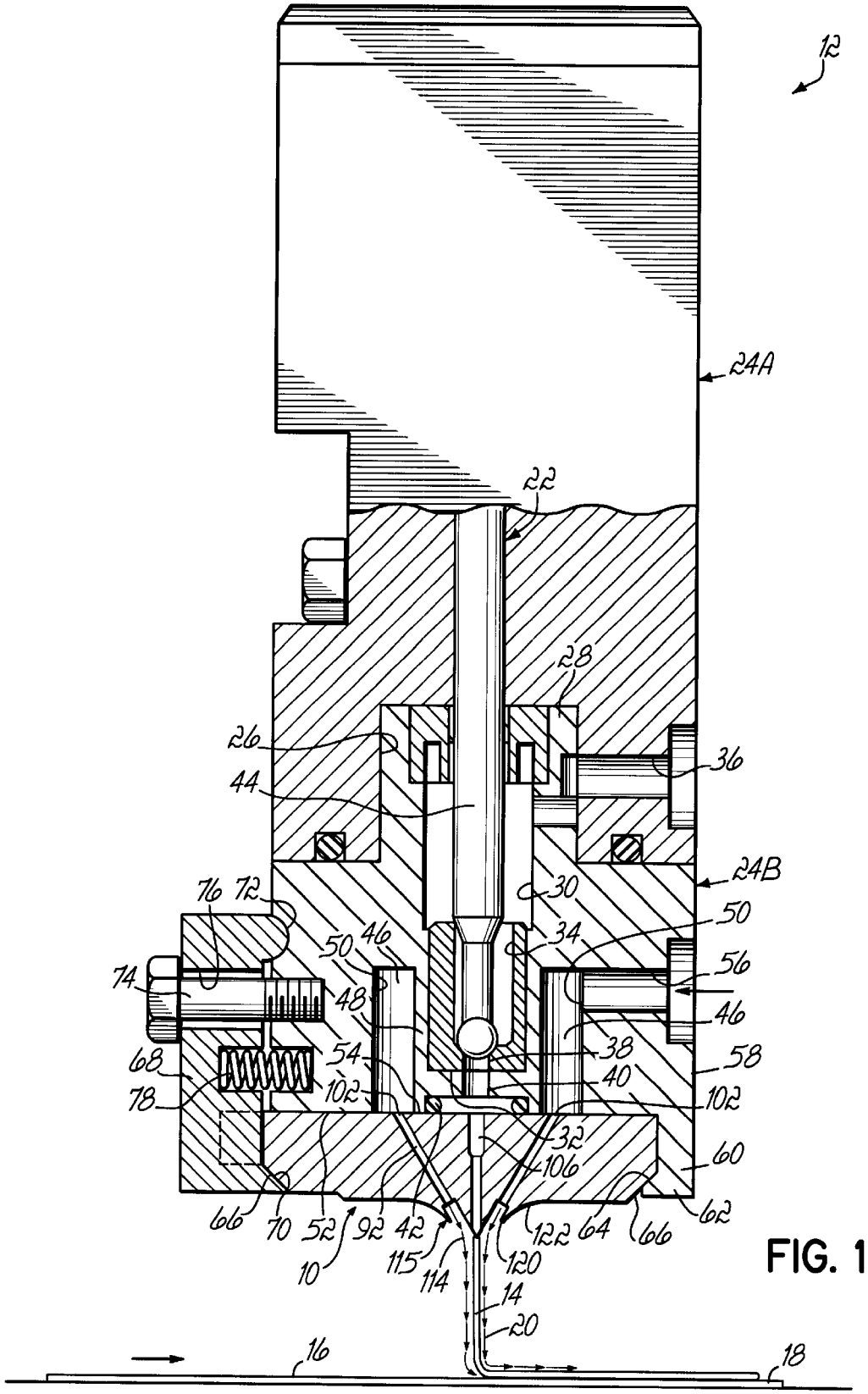
FIG. 1 is a partial cross-sectional view of a die module including a meltblowing die tip in accordance with the principles of the present invention for depositing liquid material onto a moving substrate.

With reference to the figures, and to FIG. 1 in particular, a meltblowing die tip 10 in accordance with the principles of the present invention is shown as part of a die module 12. For purposes of simplifying the description of the present invention, the preferred embodiment will hereinafter be described in relation to meltblowing of hot melt thermoplastic adhesives, but those of ordinary skill in the art will readily appreciate application of the present invention to dispensing of other materials as well.

These include, but are not limited to airless spray systems which apply a liquid to a moving web or substrate, systems which use dispensed air to move or fiberize the dispensed liquid before contacting a non-moving substrate and systems which use dispensed air to move or fiberize the dispensed liquid before contacting a moving substrate.

As will be described in detail below, die module 12 is operable to dispense a plurality of filaments 14 (FIG. 1), such as filaments of hot melt adhesive, from the die tip 10 onto a surface 16 of a moving substrate 18. As the substrate 18 moves toward the die tip 10, the air between the substrate 18 and die tip 10 is agitated and moved in the same general direction as the substrate 18. This layer of air, referred to as entrained air, is indicated diagrammatically as numeral 20 in FIGS. 3A and 3B and moves in a common direction with the substrate 18. The entrained air 20 generally comprises a boundary layer of moving air which is created by surface friction of the substrate 18 as it moves. Particles (not shown) of dust and other materials are suspended in the entrained air 20 and are carried toward the die tip 10 with movement of the substrate 18.

It will be appreciated that one or more of the die modules 12 may be mounted in side-by-side relationship to a manifold (not shown) that distributes hot melt adhesive and hot air to each of the die modules 12. A valve actuator assembly (not shown) can be connected between the manifold (not shown) and a source of hot melt adhesive (not shown) for controlling flow of hot melt adhesive to the multiple die modules 12. Each die module 12 includes an internal valve mechanism 22 (FIGS. 1 and 2) that permits the pattern width of liquid material dispensed across the substrate 18 to be selectively varied by opening and closing various valves in the side-by-side die modules 12. A detailed description of the manifold (not shown), valve actuator assembly (not shown) and connection of die modules 12 in side-by-side relationship to the manifold is provided in U.S. Ser. No. 09/021,426, entitled "Modular Die With Quick Change Die Tip Or Nozzle" and assigned to the common assignee, the disclosure of which is hereby incorporated herein by reference in its entirety.

Figure 2:
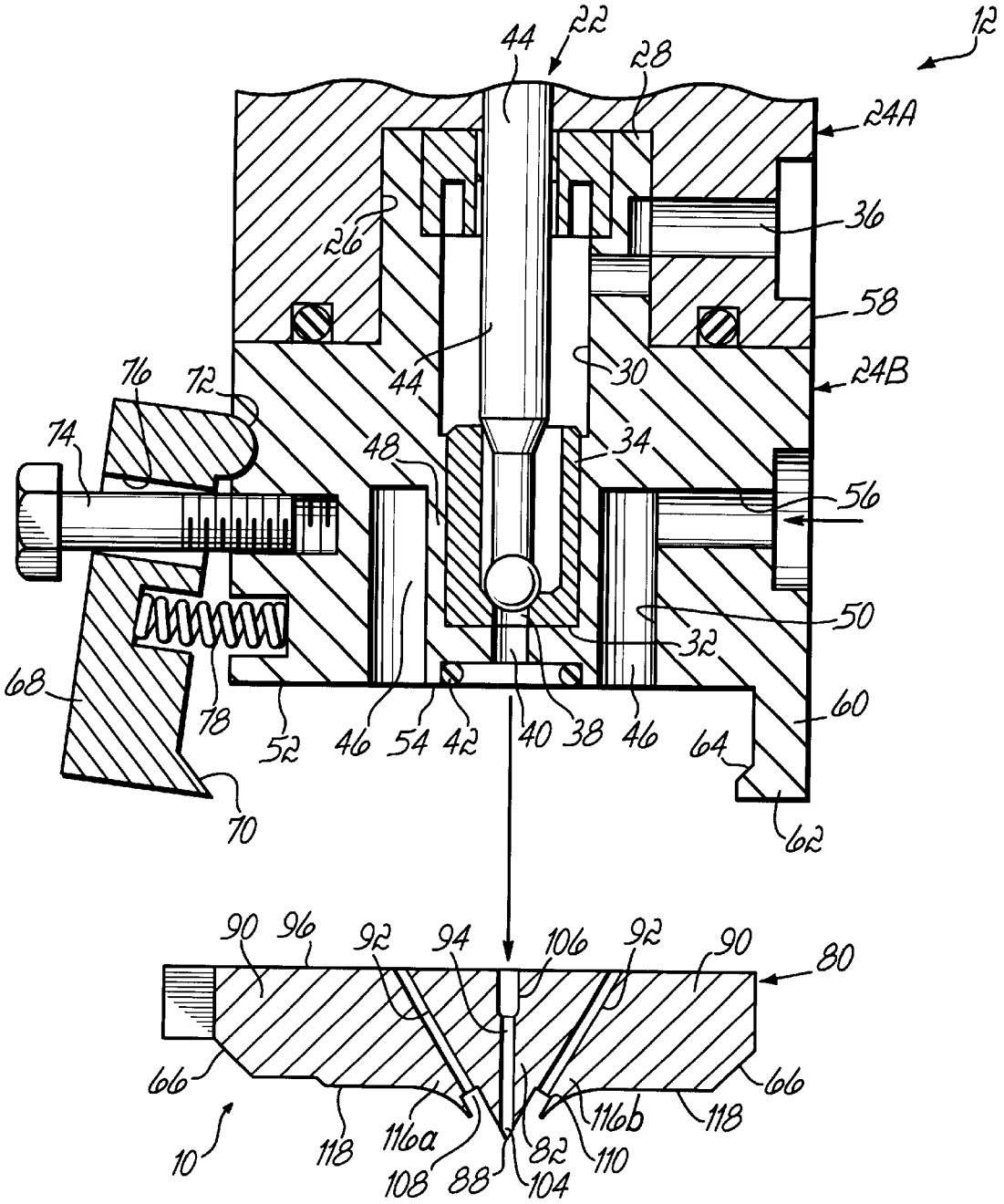
FIG. 2 is a partial disassembled view of the die module including die tip shown in FIG. 1.

Referring to FIGS. 1 and 2, each die module 12 includes an upper die body 24A and a lower stem seat body or die body 24B. Briefly, die body 24A has formed therein a lower downwardly opening recess 26 that is adapted to receive a cylindrically shaped projection 28 extending upwardly from lower die body 24B. A bore 30 extends downwardly through die body 24B and terminates at a bottom surface 32, and a valve insert 34 is mounted in the lower end of the bore 30 in contact with the bottom surface 32. Liquid flow passage 36 formed in die body 24A delivers liquid material, such as hot melt adhesive, from the manifold (not shown) to the bore 30. Ports 38 and 40 formed, respectively, in valve insert 34 and bottom surface 32 serve as a fluid outlet for bore 30. The lower end of port 40 is provided with an O-ring 42. The inlet to port 38 is chamfered to provide a valve seat for a pneumatically controlled valve stem 44 extending through the upper and lower die bodies 24A and 24B. Movement of the valve stem 44 away from and toward the valve seat selectively starts and stops the flow of liquid through the die module 12.

As shown in FIGS. 1 and 2, the lower end of the die body 24B has formed therein a downwardly opening air chamber 46 which surrounds a central cylindrical portion 48. The air chamber 46 is defined by interior walls 50 and central cylindrical portion 48. Bore 30 and port 40 are formed in central cylindrical portion 48. Bottom surfaces 52 and 54 of die body 24B are coplanar for receiving the die tip 10 as described in detail below. Air flow passage 56 formed in die body 24B delivers air to the air chamber 46.

The back side 58 of die body 24B, i.e., the side mounted to the manifold (not shown), has a downwardly projecting narrow edge portion 60 terminating at end 62. A shoulder 64 of edge portion 60 is shaped to receive and support a complementary shaped shoulder 66 of the die tip 10. A retainer plate 68 is mounted to the front of die body 24B and comprises a body portion having an inwardly projecting shoulder 70 at its lower end and an inwardly projecting rounded member 72 at its upper end. A bolt 74 extends through a hole 76 formed in the retainer plate 68 that permits the lower end to move outwardly by action of springs 78 when the bolt 74 is sufficiently unscrewed (FIG. 2). The die tip 10 is inserted in place in contact with the coplanar bottom surfaces 52 and 54 of die body 24B by screwing bolt 74 into die body 24B, thereby compressing springs 78 and bringing shoulders 64 and 70 into contact with complementary shaped shoulders 66 on the die tip 10. Details of the construction and operation of die module 12, and the removable mounting of a die tip to the die body 24B, are provided in co-pending U.S. Ser. No. 09/021,426 previously incorporated herein by reference in its entirety to which the reader is referred.

Meltblowing die tip 10 is the primary focus of the present invention and includes a base member 80 which is generally coextensive with the bottom surface 52 of die body 24B. Die tip 10 is a meltblowing nozzle having a triangular nosepiece 82 extending outwardly from the base member 80 and toward the substrate 18. The nosepiece 82 is defined by converging surfaces 84 and 86 (FIG. 3) which meet at apex 88. The apex 88 may be discontinuous, but preferably is continuous along the full width of the die tip 10.

The portions 90 of the base member 80 extending laterally from the nosepiece 82 serve as flanges for mounting the die tip 10 to the die body 24B and have multiple air flow passages 92 and liquid flow passages 94 for conducting air and hot melt adhesive, respectively, through the base member 80. The die tip 10 includes upper surface 96 which is mounted on bottom surface 52 of die body 24B, closing air chamber 46. Upper surface 96 also engages bottom surface 54, compressing O-ring 42, thereby providing a fluid seal at the junction of these two surfaces. Upper surface 96 of base member 80 is substantially coextensive with the outer periphery of surface 52. Details of the arrangement of the air flow passages 92 and liquid flow passages 94 through the base member 80 are provided in co-pending U.S. Ser. No. 09/021,426 previously incorporated herein by reference in its entirety to which the reader is referred.

Figure 3A:
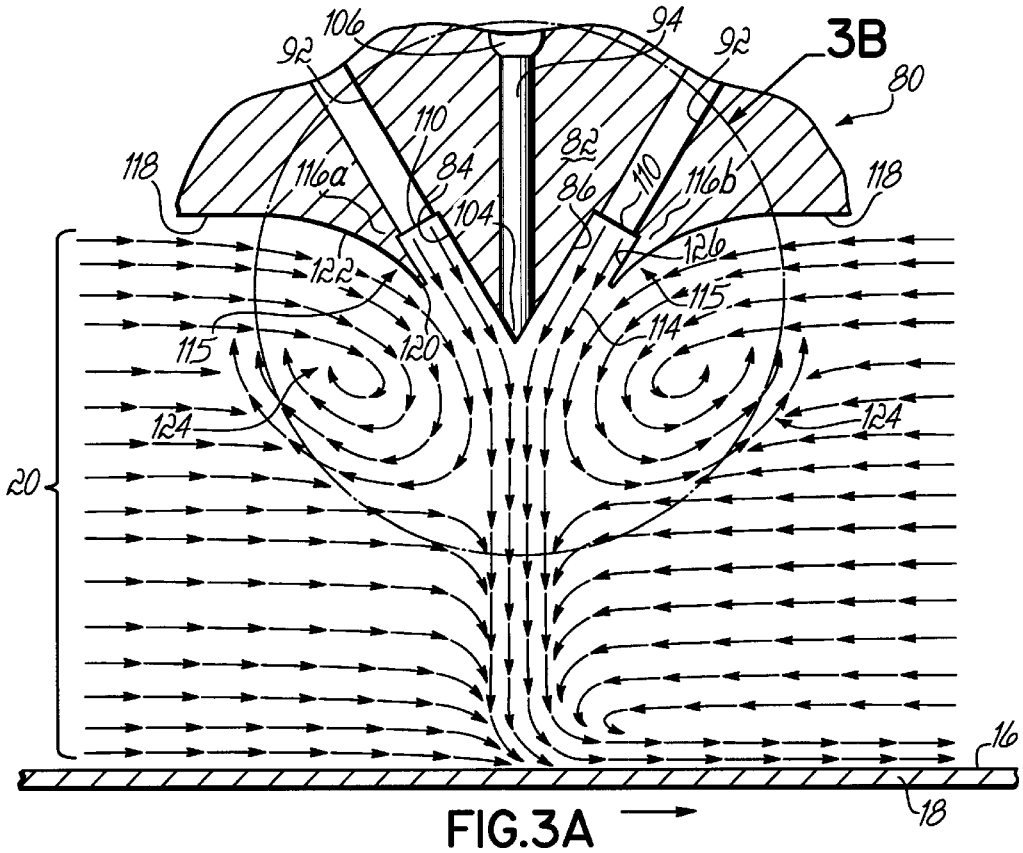
FIG. 3A is an enlarged partial cross-section view of the die tip of FIG. 1, diagrammatically illustrating flows of high velocity air and entrained air.
Figure 3B:
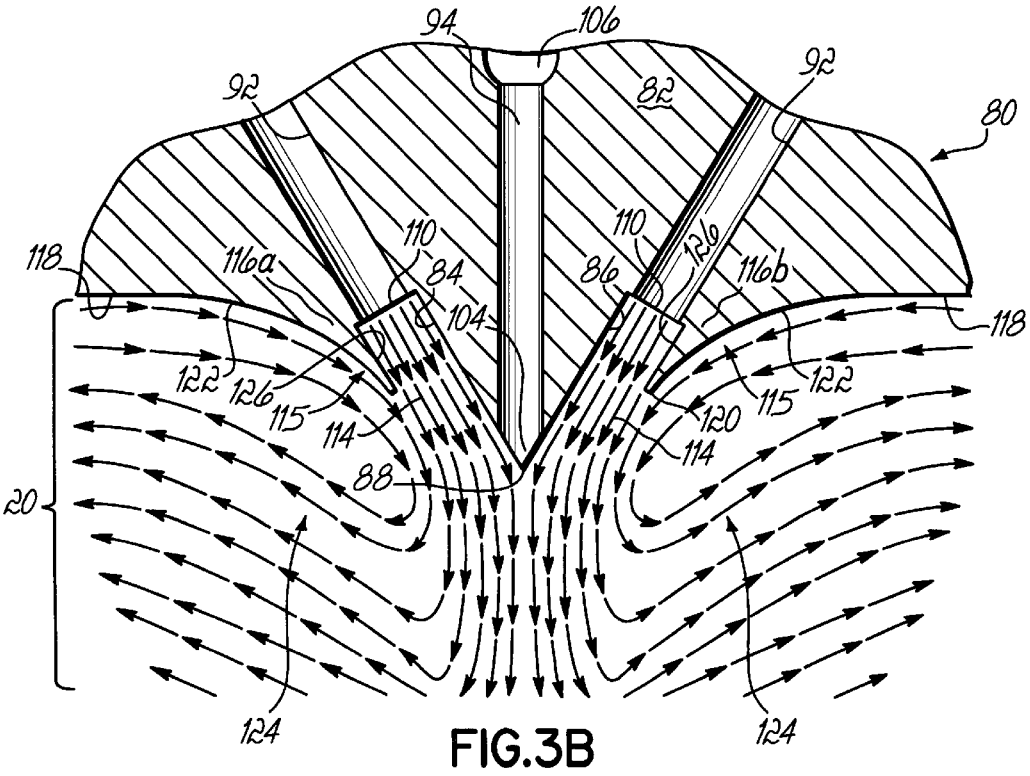
FIG. 3B is an enlarged view of the circled area in FIG. 3A.
Figure 4:
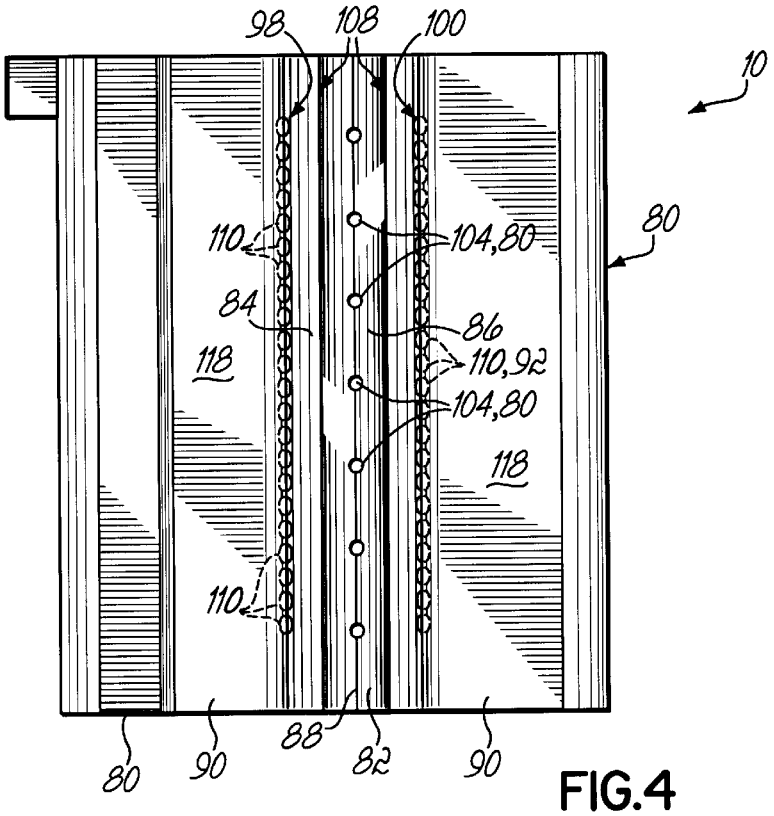
FIG. 4 is a bottom elevational view of the die tip shown in FIG. 1.
Figure 5:
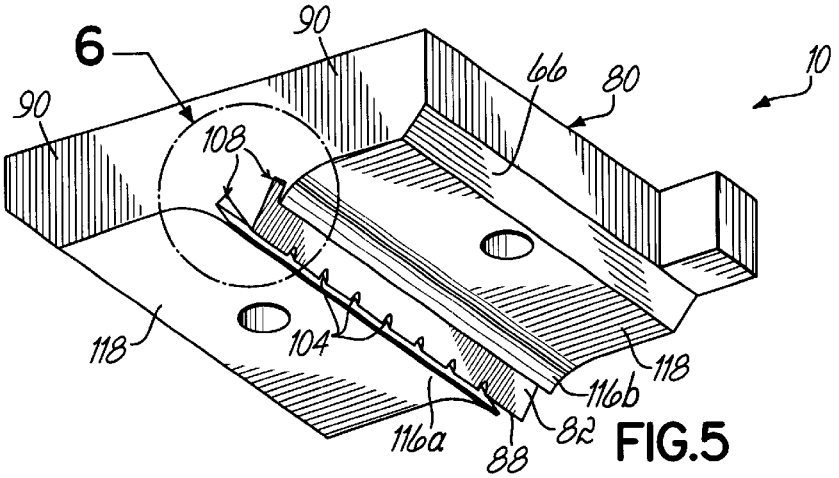
FIG. 5 is a bottom perspective view of the die tip shown in FIG. 1.

Briefly, as shown in FIG. 4, the flanges 90 of the base member 80 have two parallel rows 98 and 100 of air flow passages 92 formed therein. As shown in FIGS. 1–3, the rows 98 and 100 of air flow passages 92 define converging planes. The plane defined by row 98 extends at the same angle as nosepiece wall 84, and the plane defined by row 100 extends at the same angle as nosepiece wall 86. With the die tip 10 mounted on the die body 24B, the inlets 102 of all air flow passages 92 register with air chamber 46 as shown in FIG. 1.

Liquid flow passages 94 are formed through base member 80 that terminate in liquid dispensing outlets 104 spaced along the apex 88. An inlet 106 (FIG. 1) formed in the upper surface 96 of base member 80 registers with port 40 of die body 24B to deliver liquid material to each of the liquid dispensing outlets 104. The liquid dispensing outlets 104 are preferably uniformly spaced along the apex 88 and extend perpendicular to the apex 88. However, the dispensing outlets 104 can be spaced along the apex 88 in a non-uniform pattern.

Figure 6:
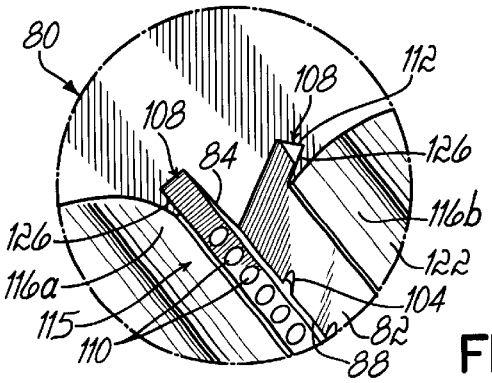
FIG. 6 is an enlarged view of the circled area in FIG. 5.

In accordance with one aspect of the present invention, a pair of parallel elongated slots 108 (FIG. 6) are formed on opposite sides of the nosepiece 82 that extend the full width of the base member 80. Each slot 108 intersects with the air flow passages 92 extending through the base member 80 on opposite sides of the nosepiece 82 to form air discharge outlets 110 at terminal ends of the air flow passages 92. Each slot 108 has a cross-sectional width that is slightly greater than the diameter of each air flow passage 92. The air discharge outlets 110 on each side of the nosepiece 82 lie in a common plane defined by a recessed wall 112 (FIG. 6) of each slot 108. The plane defined by each recessed wall 112 is substantially transverse to the axes of the air flow passages 92 on each side of the nosepiece 82, and the axis of each air flow passage 92 generally intersects the longitudinal axis of each slot 108. In this way, the air discharge outlets 110 are formed with a circular shape and are configured to discharge high velocity air jets, indicated diagrammatically as numeral 114 in FIGS. 3A and 3B, generally parallel to the converging walls 84 and 86 of the nosepiece 82.

As shown in FIGS. 3A and 3B, the high velocity air jets 114 on opposite sides of the nosepiece 82 are directed toward the dispensed filaments 14 (FIG. 1) to draw down and attenuate the filaments 14 to a reduced final diameter, typically in the range of about 5 to about 50 microns for hot melt adhesives as understood by those of ordinary skill in the art. The filaments 14 are deposited at random on surface 16 of substrate 18 to form an adhesive layer thereon onto which may be laminated another layer such as film or other types of materials or fabrics. Of course, those of ordinary skill in the art will appreciate that the air discharge outlets 110 on each side of the nosepiece 82 could be replaced with a pair of elongated air slots without departing from the spirit or scope of the present invention.

In accordance with another aspect of the present invention, an air foil 115 is formed to extend outwardly from a lowermost surface 118 of the base member 80 and toward the substrate 18. Air foil 115 preferably comprises a pair of air deflecting members 116*a* and 116*b* that extend outwardly from the lowermost surface 118 toward the substrate 18. The air deflecting members 116*a*, 116*b* each terminate in an elongated lip 120 (FIGS. 3A and 3B) that is positioned vertically intermediate the lowermost surface 118 of the base member 80 and the apex 88 of nosepiece 82. The air deflecting members 116*a*, 116*b* preferably extend the full width of the base member 80 and are positioned outboard of, and generally parallel with, the parallel rows 98 and 100 of air discharge outlets 110.

The air deflecting member 116*a* positioned upstream of the nosepiece 82 has an outer surface 122, such as a radiused or otherwise curved surface, that is configured to deflect the entrained air 20 moving toward the die tip 10, due to aspiration caused by the high velocity air jets 114 and to air movement caused by the moving substrate 18, in a direction away from the air discharge outlets 110 and the wall 84 of the nosepiece 82 as shown in FIGS. 3A and 3B. The air deflecting member 116*a* positioned upstream of the nosepiece 82 is further configured to deflect the entrained air 20 moving toward the die tip 10 at least partially toward the substrate 18, and to create a vortex, indicated diagrammatically as numeral 124 in FIGS. 3A and 3B, that provides a positive air flow in a direction away from the air discharge outlets 110.

The air deflecting member 116*b* positioned downstream of the nosepiece 82 also has an outer surface 122, such as a radiused or otherwise curved surface, that is configured to deflect the entrained air 20 moving toward the die tip 10, due to aspiration caused by the high velocity air jets 114, in a direction away from the air discharge outlets 110 and the wall 86 of the nosepiece 82. The air deflecting member 116*b* is further configured to deflect the entrained air 20 at least partially toward the substrate 18, and to create a vortex 124 that provides a positive air flow in a direction away from the air discharge outlets 110.

While a curved outer surface 122 is shown on air deflecting members 116*a*, 116*b*, it is contemplated that other surface configurations or shapes, including one or more non-curved surfaces, are possible as well that will function to divert the flow of turbulent entrained air 20 away from the air discharge outlets 110 and refocus the entrained air 20 into an accurate, open-channel flow in accordance with the principles of the present invention as shown in FIG. 3A. As a result of the entrained air 20 being directed away from the air discharge outlets 110, the uniformity of the process air, high velocity air and entrained air combined, is increased, since the entrained air combines with the high velocity air at a point further away from the air discharge outlets 110 than would otherwise occur, as shown in FIG. 3A. This combination of the high velocity air and entrained air reduces the effect of the moving entrained air on the high velocity air, and reduces the amount of dust or other particles built up at the die tip 10. Thus, the air deflecting members 116*a*, 116*b* improve efficiency and focus of the pattern of the filaments 14 applied to the moving substrate 18.

Each air deflecting member 116*a*, 116*b* has an inner wall 126 (FIGS. 3A and 3B) that is generally parallel with the converging walls 84 and 86 of the nosepiece 82 to shield the air discharge outlets 110 from the entrained air 20. The air deflecting members 116*a*, 116*b* may be integral with the base member 80 or separately attached to extend outwardly from the lowermost surface 18 of the base member 80. While a pair of air deflecting members 116*a*, 116*b* is shown, it is contemplated that only one air deflecting member 116*a* may be provided upstream of the nosepiece 82 to contact and deflect the entrained air 20 moving toward the die tip 10 as described in detail above.

The elongated slots 108 formed on the opposite sides of the nosepiece 82 serve two important functions. First, the slots 108 intersect the air flow passages 92 in a manner that forms circular-shaped air discharge outlets 110 at terminating ends of the air flow passages 92. The circular-shaped air discharge outlets 110 improve the behavior of the high velocity air jets 114 and also increase air efficiency over elliptical air discharge outlets of the past. Secondly, the elongated slots 108, in combination with the air deflecting members 116*a*, 116*b*, shield the air discharge outlets 110 from the entrained air 20 moving toward the die tip 10. The air deflecting members 116*a*, 116*b* serve to deflect the entrained air 20 in a direction away from the air discharge outlets 110 and the walls 84, 86 of the nosepiece 82. This protects the air discharge outlets 110 from the buildup of dust and other debris in the vicinity of the nosepiece 82 that would otherwise lead to partial or complete blockage of one or more of the air discharge outlets 110. The air deflecting members 116*a*, 116*b* thereby extend the life cycle of the die tips 10 and improve both spray efficiency and reliability. Further, the "self-cleaning" capability of die tip 10 reduces the need for expensive dust removal systems in the vicinity of the meltblowing dispensing system.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicants' general inventive concept.

Having described the invention, we claim:

1. A die tip for use in dispensing liquid material onto a moving substrate having a layer of entrained air moving in a common direction therewith, comprising:

a base member having a surface facing the substrate;

at least one liquid flow passage formed in said base member terminating in a liquid dispensing outlet capable of dispensing liquid material toward the substrate; and an air deflecting projection extending outwardly from said surface of said base member and extending toward the substrate, said air deflecting projection being capable of deflecting the moving entrained air in a direction away from said liquid dispensing outlet and toward the substrate.

2. The die tip of claim 1 further comprising a pair of air deflecting projections disposed in spaced relationship outboard of said, liquid dispensing outlet.

3. The dip tip of claim 1 further comprising at least one air flow passage formed in said base member terminating in an air discharge outlet capable of discharging air toward the liquid material dispensed from said liquid dispensing outlet.

4. The die tip of claim 3 further comprising:

a nosepiece extending outwardly from said base member and extending toward the substrate, said nosepiece terminating in an apex extending substantially a full width of said base member;

a plurality of liquid flow passages formed in said base member terminating in a plurality of liquid dispensing outlets formed in spaced relationship along said apex;

a plurality of air flow passages formed in said base member terminating in a plurality of air discharge outlets formed in spaced relationship in a pair of parallel rows disposed along opposite sides of said nosepiece; and at least one air deflecting projection disposed outboard of one of said parallel rows of air discharge outlets.

5. The die tip of claim 4 wherein each of said air discharge outlets is circular in shape.

6. The die tip of claim 4 wherein said at least one air deflecting projection extends substantially the full width of said base member and substantially parallel to said nosepiece.

7. The die tip of claim 6 wherein said nosepiece comprises a pair of converging walls that meet at said apex, and further wherein said at least one air deflecting projection has an inner wall spaced from and extending generally parallel to one of said converging walls.

8. The die tip of claim 7 further comprising:

an elongated slot extending along at least one side of said nosepiece; and each air discharge outlet in one of said parallel rows fluidly communicating with said elongated slot.

9. The die tip of claim 8 wherein said elongated slot terminates in a recessed wall, and further wherein said air discharge outlets in said one row lie in a common plane defined by said recessed wall.

10. The die tip of claim 9 wherein said common plane is substantially transverse to axes of said air passages that terminate in said one row of air discharge outlets.

11. The die tip of claim 1 wherein said air deflecting member has a curved outer wall adapted to contact and deflect the moving entrained air in a direction away from said air discharge outlet.

12. A die tip for use in dispensing liquid material onto a substrate having a layer of entrained air between the die tip and the substrate, comprising:

a base member having a surface facing the substrate;

at least one liquid flow passage formed in said base member terminating in a liquid dispensing outlet capable of dispensing liquid material toward the substrate;

at least one air flow passage formed in said base member terminating in an air discharge outlet capable of discharging air toward the liquid material dispensed from said liquid dispensing outlet, the discharged air aspirating the entrained air toward said air discharge outlet; and an air deflecting projection extending outwardly from said surface of said base member and extending toward the substrate, said air deflecting projection being capable of deflecting the aspirated entrained air in a direction away from said air discharge outlet and toward the substrate.

13. The die tip of claim 12 further comprising a pair of air deflecting projections disposed in spaced relationship outboard of said liquid dispensing outlet and said air discharge outlet.

14. The die tip of claim 12 wherein said air deflecting projection extends substantially a full width of said base member.

15. The die tip of claim 12 wherein said air deflecting projection has a curved outer wall adapted to contact and deflect the aspirated entrained air in a direction away from said air discharge outlet.

16. A die tip for use in dispensing liquid material onto a moving substrate having a layer of entrained air moving in a common direction therewith, comprising:

a base member having a surface facing the substrate;

a plurality of liquid dispensing outlets formed in said base member, each being capable of dispensing liquid material toward the substrate;

a plurality of air flow passages formed in said base member terminating in air discharge outlets capable of discharging air toward the liquid material dispensed from said liquid dispensing outlets; and at least one air deflecting projection extending outwardly from said surface of said base member and extending toward the substrate, said at least one air deflecting projection being capable of deflecting the moving entrained air in a direction away from said air discharge outlets and toward the substrate.

17. The die tip of claim 16 further comprising a pair of air deflecting projections disposed in spaced relationship outboard of said plurality of liquid dispensing outlets and said plurality of air discharge outlets.

18. The die tip of claim 16 wherein said at least one air deflecting projection extends substantially a full width of said base member.

19. The die tip of claim 16 wherein said at least one air deflecting projection has a curved outer wall adapted to contact and deflect the moving entrained air in a direction away from said air discharge outlets.

20. A die tip for use in dispensing liquid material onto a moving substrate having a layer of entrained air moving in a common direction therewith, comprising:

a base member having a surface facing the substrate and a nosepiece extending outwardly therefrom and extending toward the substrate, said nosepiece terminating in an apex extending substantially a full width of said base member;

a plurality of liquid dispensing outlets formed in spaced relationship along said apex, each being capable of dispensing liquid material toward the substrate;

at least one elongated slot extending along opposite sides of said nosepiece;

a plurality of air flow passages formed in said base member terminating in air discharge outlets capable of discharging air toward the liquid material dispensed from said liquid dispensing outlets; and at least one air deflecting projection extending outwardly from said surface of said base member and extending toward the substrate, said at least one air deflecting projection being capable of deflecting the moving entrained air in a direction away from said air discharge outlets and toward the substrate.

21. The die tip of claim 20 further comprising a pair of air deflecting projections disposed in spaced relationship outboard of said plurality of liquid dispensing outlets and said plurality of air discharge outlets.

22. The die tip of claim 20 wherein said at least one air deflecting projection extends substantially the full width of said base member and substantially parallel to said nosepiece.

23. The die tip of claim 20 wherein said nosepiece comprises a pair of converging walls that meet at said apex, and further wherein said at least one air deflecting projection has an inner wall spaced from and extending generally parallel to one of said converging walls.

24. The die tip of claim 20 wherein said at least one air deflecting projection has a curved outer wall adapted to contact and deflect the moving entrained air in a direction away from said air discharge outlets.

25. A die module for dispensing liquid material onto a moving substrate having a layer of entrained air moving in a common direction therewith, comprising:

a die body having:

an air flow passage formed therein;

a liquid flow passage formed therein;

a valve member capable of opening and closing the liquid flow passage; and a die tip mounting surface; and a die tip positioned on said mounting surface of said die body and having a surface facing the substrate;

a plurality of liquid dispensing outlets formed in said die tip, each being capable of dispensing liquid material toward the substrate;

a plurality of air flow passages formed in said die tip terminating in air discharge outlets capable of discharging air toward the liquid material dispensed from said liquid dispensing outlets; and at least one air deflecting projection extending outwardly from said die tip and extending toward the substrate, said at least one air deflecting projection being capable of deflecting the moving entrained air in a direction away from said air discharge outlets and toward the substrate.

26. The die module of claim 25 further comprising a pair of air deflecting projections disposed in spaced relationship outboard of said plurality of liquid dispensing outlets and said plurality of air discharge outlets.

27. The die module of claim 25 wherein said at least one air deflecting projection extends substantially a full width of said base member.

28. The die module of claim 27 wherein said at least one air deflecting projection has a curved outer wall adapted to contact and deflect the moving entrained air in a direction away from said air discharge outlets.

29. The die module of claim 25 wherein each of said air discharge outlets is circular in shape.

30. A method of dispensing liquid material from a die tip onto a substrate having a layer of entrained air between the die and the substrate, the die tip having a base member, a plurality of liquid dispensing outlets and a plurality of air discharge outlets formed in the base member and an air deflecting projection extending outwardly from the base member and toward the substrate, comprising:

dispensing liquid material from the plurality of liquid dispensing outlets toward the substrate;

discharging air from the plurality of air discharge outlets toward the liquid material dispensed from the plurality of liquid dispensing outlets; and deflecting the moving entrained air in a direction away from the plurality of air discharge outlets with the air deflecting projection and toward the substrate.

31. The method of claim 30 further comprising forming a vortex in the moving entrained air to provide a positive air flow in a direction away from the plurality of air discharge outlets.

32. The method of claim 30 further comprising dispensing air on opposite sides of the liquid material dispensed from the plurality of liquid dispensing outlets.

33. A method of dispensing liquid material from a die tip onto a substrate having a layer of entrained air between the die tip and the substrate, the die tip having a base member, at least one liquid dispensing outlet and at least one air discharge outlet formed in the base member and an air deflecting projection extending outwardly from the base member and toward the substrate, comprising:

dispensing liquid material from the at least one liquid dispensing outlet toward the substrate;

discharging air from the at least one air discharge outlet toward the liquid material dispensed from the at least one liquid dispensing outlet, the discharged air aspirating the entrained air toward the at least one air discharge outlet; and deflecting the aspirated entrained air in a direction away from the at least one air discharge outlet with the air deflecting projection and toward the substrate.

34. The method of claim 33 further comprising forming a vortex in the entrained air to provide a positive air flow in a direction away from the at least one air discharge outlet.

35. A liquid dispensing die for use in dispensing liquid material onto a moving substrate having a layer of entrained air moving in a common direction therewith, comprising:

a plurality of liquid dispensing outlets formed in said liquid dispensing die, each being capable of dispensing liquid material toward the substrate;

a plurality of air of flow passages formed in said liquid dispensing die terminating in air discharge outlets capable of discharging air toward the liquid material dispensed from said liquid dispensing outlets; and at least one air deflecting projection extending outwardly from a surface of said liquid dispensing die facing the substrate and extending toward the substrate, said at least one air deflecting projection being capable of deflecting the moving entrained air in a direction away from said air discharge outlets and toward the substrate.

36. A liquid dispensing die for use in dispensing liquid material onto a substrate having a layer of entrained air between the liquid dispensing die and the substrate, comprising:

at least one liquid flow passage formed in said liquid dispensing die terminating in a liquid dispensing outlet capable of dispensing liquid material toward the substrate;

at least one air flow passage formed in said liquid dispensing die terminating in an air discharge outlet capable of discharging air toward the liquid material dispensed from said liquid dispensing outlet, the discharged air aspirating the entrained air toward said air discharge outlet; and an air deflecting projection extending outwardly from a surface of said liquid dispensing die facing the substrate and extending toward the substrate, said air deflecting projection being capable of deflecting the aspirated entrained air in a direction away from said air discharge outlet and toward the substrate.

37. A liquid dispensing die for use in dispensing liquid material onto a moving substrate having a layer of entrained air moving in a common direction therewith, comprising:

at least one liquid flow passage formed in said liquid dispensing die terminating in a liquid dispensing outlet capable of dispensing liquid material toward the substrate; and an air deflecting projection extending outwardly from a surface of said liquid dispensing die facing the substrate and extending toward the substrate, said air deflecting projection being capable of deflecting the moving entrained air in a direction away from said liquid dispensing outlet and toward the substrate.

* * * * *